US011142886B2

(12) United States Patent
Renger et al.

(10) Patent No.: US 11,142,886 B2
(45) Date of Patent: Oct. 12, 2021

(54) METHOD FOR CONTROLLING THE MOVEMENT OF AN ARTICULATED HOSE CARRIER OF A SUCTION EXCAVATOR

(71) Applicant: RSP GMBH, Saalfeld (DE)

(72) Inventors: Marina Renger, Saalfelder Hoehe (DE); Karl-Heinz Renger, Saalfelder Hoehe (DE); Jens Graber, Saalfelder Hoehe OT Unterwirbach (DE)

(73) Assignee: RSP GMBH, Saalfeld (DE)

( * ) Notice: Subject to any disclaimer, the term of this patent is extended or adjusted under 35 U.S.C. 154(b) by 418 days.

(21) Appl. No.: 16/092,423

(22) PCT Filed: Mar. 21, 2017

(86) PCT No.: PCT/EP2017/056729
§ 371 (c)(1),
(2) Date: Oct. 9, 2018

(87) PCT Pub. No.: WO2017/174350
PCT Pub. Date: Oct. 12, 2017

(65) Prior Publication Data

US 2020/0217043 A1 Jul. 9, 2020

(30) Foreign Application Priority Data

Apr. 8, 2016 (DE) ..... 10 2016 106 427.0

(51) Int. Cl.
*E02F 3/90* (2006.01)
*E02F 3/88* (2006.01)
*E02F 3/94* (2006.01)

(52) U.S. Cl.
CPC ..... *E02F 3/907* (2013.01); *E02F 3/8825* (2013.01); *E02F 3/905* (2013.01); *E02F 3/94* (2013.01)

(58) Field of Classification Search
CPC ..... E02F 3/907; E02F 3/8825; E02F 3/905; E02F 3/94
See application file for complete search history.

(56) References Cited

U.S. PATENT DOCUMENTS 4,242,815 A * 1/1981 Vermeulen ..... E02F 3/907 37/308
4,352,250 A * 10/1982 de Vries ..... E02F 3/905 37/334

(Continued)

FOREIGN PATENT DOCUMENTS

CN 101 525 944 A 9/2009
CN 103 176 409 A 6/2013

(Continued)

OTHER PUBLICATIONS

English translation of International Preliminary Report on Patentability dated Oct. 9, 2018, issued in connection with corresponding International Application No. PCT/EP2017/056729 (8 pages total).

(Continued)

*Primary Examiner* — Jamie L McGowan
(74) *Attorney, Agent, or Firm* — Stuart H. Mayer; Mayer & Williams PC

(57) ABSTRACT

A method for controlling the movement of an articulated hose mount having at least n>2 members, wherein a change in angle can be induced between neighboring members with the help of a respective drive includes:

a) determining the starting position of the n members with the help of sensors;

b) input of a direction vector and a velocity parameter;

c) determining a target position, which should be taken by a suction crown, on the free end of the last member;

(Continued)

d) determining n angle changes which must be carried out on the n members in order to reach the target position while maintaining the following condition:

d.i. the suction crown moves into the target position along a straight path of movement;

e) controlling the drives associated with the n members in order to perform the predetermined angle change on the n members; and f) cyclically repeating the aforementioned method steps until the direction vector and/or the velocity parameter are zero.

9 Claims, 5 Drawing Sheets

(56) References Cited

U.S. PATENT DOCUMENTS

| | | | | |
|---|---|---|---|---|
| 2013/0189060 | A1* | 7/2013 | Lamonte | E02F 3/90 414/507 |
| 2013/0270194 | A1* | 10/2013 | Allen | E02F 7/065 210/747.4 |
| 2014/0338233 | A1* | 11/2014 | Albers | E02F 5/28 37/308 |
| 2015/0321594 | A1* | 11/2015 | Harms, Jr. | E02F 7/04 37/304 |
| 2018/0119375 | A1* | 5/2018 | Renger | E01H 1/0809 |

FOREIGN PATENT DOCUMENTS

| | | | |
|---|---|---|---|
| DE | 38 37 670 | A1 | 5/1990 |
| DE | 90 16 448 | U1 | 2/1991 |
| DE | 44 41 574 | A1 | 5/1996 |
| DE | 299 02 562 | U1 | 4/1999 |
| DE | 198 51 111 | C1 | 12/1999 |
| DE | 10 2011 119 924 | A1 | 6/2013 |
| DE | 10 2015 208577 | A1 | 11/2016 |
| EP | 0 368 129 | B1 | 8/1993 |
| EP | 1 939 134 | A2 | 7/2008 |
| WO | 00/28159 | A1 | 5/2000 |
| WO | 00/47831 | A1 | 8/2000 |
| WO | 2013/079671 | A1 | 6/2013 |
| WO | 2015/109976 | A1 | 7/2015 |
| WO | 2016/180759 | A1 | 11/2016 |

OTHER PUBLICATIONS

English translation of International Search Report dated Jul. 4, 2017, issued in connection with corresponding International Application No. PCT/EP2017/056729 (3 pages total).

* cited by examiner

METHOD FOR CONTROLLING THE MOVEMENT OF AN ARTICULATED HOSE CARRIER OF A SUCTION EXCAVATOR

FIELD

The present invention relates to a method for controlling the movement of an articulated hose mount, which carries and positions the suction hose of a suction dredge. Such an articulated hose mount has at least n>2 members, between which a change in angle can be induced with the help of an associated drive. The invention also relates to a suction dredge having a controller configured for carrying out such a method.

BACKGROUND

A suction dredge is a vehicle having a vehicle frame, which in turn carries a material collecting container that can preferably be tilted outward. In expedient embodiments, such a suction dredge has a telescoping device, which has two telescoping arms, each of which on the container side is mounted on a tilt axle, about which the material collecting container can be rotated, wherein the frame-side end of each telescoping arm is mounted on the vehicle frame.

DE 38 37 670 A1 discloses a suction dredge comprising a pneumatic suction spout, a collecting container for the soil picked up, with the suction spout opening into the collecting container, into which the soil from the suction air stream is deposited, as well as a suction fan connected to the collecting container for generating the suction air stream. Guide elements for this suction spout and filters for cleaning the suction air before the air leaves the suction container again and is discharged to the environment belong to the additional conventional components of the suction dredge.

DE 198 51 111 C1 describes a suction dredge, which has a collecting chamber arranged at the front in the direction of travel in the material collecting container and a filter situated at the rear in the direction of travel.

DE 299 02 562 U1 also describes a suction dredge, which operates according to the thin stream conveyor principle and is configured mainly for receiving the excavated soil.

DE 44 41 574 A1 describes a clearing device for the suction spout of a suction dredge, comprising a tool that can be driven to rotate relative to the suction spout. This material is mounted on the spout and is situated upstream from the suction opening of the suction spout. In particular, the working range, which goes beyond the cross section of the spout due to the retrofittable tool, is expanded.

For guidance of the suction hose of a suction dredge, two variants have become established, namely the telescoping hose mount and the articulated hose mount. The telescoping hose mount guides the hose only partially, so that the suction connection on which the material is accommodated must be guided manually by an operator. Therefore, the articulated hose mount, which is also known as a force arm, a guide arm or an articulated lever, has been preferred for many years. It offers the advantage of complete hydraulic guidance and good stability, which in turn permits more accurate control of the working movements without applying force and while using a remote control, which is preferably carried by the operator.

DE 90 16 448 U1 describes a suction dredge having an articulated jib that is operated by remote control. By means of individual handlebars, the suction head can be manipulated into the desired suction position by means of hydraulic pressure cylinders by remote control.

DE 10 2011 119 924 A1 discloses a suction dredge for picking up suction material, such as soil or sludge, having a pneumatic suction turbine for generating a suction air stream, said turbine being connected to a suction container with a suction hose opening into it. The suction hose is situated on a guide arm in the manner of an articulated hose mount attached to a vertical rotational axis to expand the working range of the suction dredge. Two suction hose connections, each opening into the collecting container in the outer side area of a rear end wall, are provided on the material collecting container. The pivot arm mounted on the rotational axis allows the working range to be extended on both sides of the vehicle but results in a substantial increase in the total length of the suction dredge and has a negative effect on the position of the center of gravity of the vehicle.

Previous means of control of the articulated hose mount have in common the significant disadvantage that the operator must manually control up to five drives individually. This is extremely complicated and requires highly skilled operating personnel as well as a great deal of training to be able to control the suction hose rapidly to the desired goal. The suction connection often strikes the ground due to inaccurate control and thus causes excessive mechanical stress on the articulated hose mount. Furthermore, there is an increased risk of damage to lines.

EP 1 939 134 A2 describes an intelligent controller for a pivot arm mounted on a rotating platform. This controller makes it possible to control a plurality of actuators as a function of control commands to move the end of the pivot arm in a defined coordinate system.

Against the background of EP 1 939 134 A2, the object of the present invention is to make available an improved method for controlling such an articulated hose mount, which supports the suction hose of a suction dredge. Another object of the invention is regarded as making available a suction dredge, which facilitates operability of the articulated hose mount with the help of such a control method and makes it more reliable.

These and additional objects are achieved by a method for controlling the movement of an articulated hose mount according to the accompanying claim 1. Furthermore, the aforementioned object is achieved by a suction dredge according to the accompanying claim 10.

SUMMARY

An articulated hose mount for a suction hose of a suction dredge comprises n members, wherein n>2, and the number of joints coupling the members is n−1. Neighboring members are each interconnected pivotably by means of a common joint in a plane. A drive is provided for each one of these joints, preferably a hydraulic cylinder, with which the angular position of the members adjacent to the joint (sections of the mount) can be changed relative to one another in order to stretch the articulated hose mount or reduce the radius of curvature of the curve of the member, so that the suction connection assumes a certain position on the free end of the suction hose.

The articulated hose mount preferably has five joints. The method according to the invention operates basically independently of the number of members and joints to be controlled wherein the advantages are manifested at three members or more. This is because two joints and/or their drives can be navigated well manually by trained operators operating two control levers simultaneously (joystick), but when there are three or more joints, complex movement sequences are necessary, but these can no longer be carried out optimally and rapidly by manual operation. Thanks to the controller according to the invention, it is no longer necessary to control each drive or hydraulic cylinder individually. An intuitively controllable articulated hose mount is instead made available.

The method according to the invention ultimately serves to move the last member (also referred to as a suction crown or suction connection) of the articulated hose mount into a predetermined position (X, Y). For this purpose, this method uses sensors, which can preferably detect the slope as well as preferably the angular velocity of the respective member as measured sensor values, wherein an electronic evaluation system converts the measured sensor values into a motion sequence for the respective drive, such that there is a steady, harmonic movement of preferably all the members of the articulated hose mount, in that all the drives are triggered appropriately and until the last member (suction crown) has reached the predetermined position (X, Y). The suction crown itself moves steady in a differentiable manner, which is preferably also true of the other members of the articulated hose mount.

In the sequence of the method according to the invention, the following steps are carried out first: in a first step, the starting position of the n members is determined with the help of sensors. It should be pointed out that it is not necessary for all members of the hose mount to be included in the control, although this is preferred. According to the invention, three or more members are automatically controlled by the controller. In the next step, at least one direction vector and a velocity parameter are input. The direction vector and the velocity parameter are preferably derived from an operating unit, on which a user is operating a joystick and deflecting it by 50% in X direction, for example.

A cylindrical coordinate system describing the movement space is assumed below, wherein the X axis runs horizontally, the Y axis runs vertically, and the X-Y plane runs through a rotational angle $\gamma$ about the Y axis in space. Unless otherwise specified, it is assumed below that the articulated hose mount lies in the X-Y plane, which stands vertically in space, wherein the suction connection can approach target positions within this plane.

In the next step, a target position, which should be assumed by the suction connection on the free end of the suction hose, is determined from the direction vector and the velocity parameter. To this end, the suction connection should travel at the velocity predetermined by the velocity parameter over the linear path predetermined by the direction vector. In the simplest case, the velocity parameter is a fixedly predetermined value. The operator preferably stipulates the velocity parameter on the operating unit, in particular by a small deflection of the joystick (low velocity) or by a great deflection (high velocity). The target position can be determined by using methods familiar to those skilled in the art, against the background of the starting position determined in this way and the target position also determined, the n changes in angle that must be carried out on the n−1 joints to reach the target position are determined by the controller with the help of corresponding control elements. The angle changes can be determined in various ways, for example, by using mathematical methods based on inverse kinematics, as described in further detail below. It is essential here for the following condition to be met: the suction connection should always travel along a straight path of movement into the target position.

Alternatively, however, it is also possible to store a table of values in the controller, so that all n−1 joints can be stored in this table for all approachable target positions, wherein the target position closest to the current position is approached along the direction vector.

In another step, the drives associated with the n−1 joints are controlled in such a way as to perform the change in angle determined previously on each one of the n members. Activation of the drives takes place essentially simultaneously in order to also ensure the aforementioned condition of linear movement of the suction connection even during the movement.

In a final step, a check is performed of whether the target position has already been reached, i.e., the direction vector is zero and/or the target position is equal to the current starting position. This condition occurs when the user no longer stipulates a direction vector and/or the velocity parameter is set at zero, while the previously determined target position is approached. If the user instead stipulates a change in direction further by continuous deflection of the joystick on the operating unit, then the aforementioned method steps are repeated in cycles and the movement of the articulated hose mount continues. The next target position is then determined. The steps in which the target position can be determined anew can be stipulated as a parameter, which is fully adequate, for example, in millimeter steps, which is fully adequate for use on a suction dredge.

By automatically pursuing a linear path of movement, operation of the articulated hose mount is greatly simplified. In the simplest case, the user specifies the direction vector in the X direction, for example, by manipulating a joystick on a remote control unit. The width of deflection corresponds to the desired speed. The controller according to the invention then takes over the control of all the n joints of the articulated hose mount and produces a steady linear movement of the suction connection in the X direction. This makes it possible to guide the suction connection in a linear path over a surface without any change in height, for example, by using joystick manipulation alone to suck up material along this path.

In a preferred embodiment, the preselectable direction vector lies in an X-Y plane extending vertically. The direction vector is therefore made up of two one-dimensional subvectors in X and Y directions. The target position therefore lies inside the X-Y plane spanning vertically. Therefore, the operating unit of the suction dredge preferably has a second operating level (joystick), which can be deflected in the second direction. Likewise, a joystick, which can be manipulated in two directions (X, Y; biaxial joystick), can be used. The controller according to the invention makes it possible for the suction connection to be moved along a straight path of movement in the X-Y plane by using the same steps for the second direction of movement. If the direction vector is set by the operator exclusively in the Y direction, then the suction connection runs vertically up or down (Y direction) without requiring a manual readjustment of individual joint drives. The suction connection can therefore be inserted easily into narrower holes without any risk of collision with the side walls.

The movement in the X plane can also be superimposed on a movement in Y the plane. Thus, the suction crown can also be moved along a straight line that rises or falls in the X-Y plane, for example. To this end, a biaxial proportional joystick may be used.

In a particularly preferred embodiment of the method, another condition that must be met is stipulated for determining the n angle changes. Therefore, during the movement, all joints should be adjusted to yield a statically optimum form of the hose mount. Mostly extended joints are statically unfavorable, whereas the articulated hose mount can better absorb the acting forces when there are smaller angles that are uniformly distributed. Therefore, the optimum statically can be regarded as a hose mount shape that approximates as closely as possible a curved shape with a uniform radius.

In addition, an embodiment in which the following additional condition is maintained in determining the changes in angle is particularly advantageous: the sum of all angle changes on the n−1 joints is minimal. This ensures that the transition to the next target position is achieved with only small adjustment distances of the individual drives on the n−1 joints. In particular, when using hydraulic drives, this also has the advantage that the required total volume flow is as small as possible for the corresponding total movement.

The controller may preferably also be used for automatic processing of predetermined movement cycles. To this end, successive target positions and/or the corresponding direction vectors as well as the velocity parameters are stored. For example, unfolding of the articulated hose mount from the transport position into a working starting position can thus take place automatically without the operator having to re-enter the motion sequence each time. Likewise, a path of movement controlled by the operator can be recorded and then retrieved repeatedly. It is also advantageous if certain limit values can be recorded in the controller, defining blocked regions, in which the hose mount should not be moved, for example, to prevent an excessively great extension when the surrounding conditions allow only a limited working height.

In a further developed embodiment of the method, in addition to the angle changes, n angular velocities, at which the angle changes can be executed in the joints, are determined for control of the drives of the n joints.

A further modified embodiment is characterized in that an angle of rotation is input to define the desired angular position of the vertically spanned X-Y plane about a rotational axis of the articulated hose mount, and the articulated hose mount is moved into this angular position by a rotational drive.

In a preferred embodiment, the articulated hose mount comprises a plurality of supporting mechanism elements, preferably five or six members (also referred to as mount sections), hydraulic cylinders for driving the individual mount sections as well as a receptacle on the frame of the suction dredge structure. In addition, a pivot drive is advantageously provided for generating the working radius.

A suction dredge according to the invention is characterized in that it comprises a control unit for controlling the movement of the articulated hose mount, which is configured to carry out the method according to the invention. A material collecting container is preferably attached to the suction dredge in such a way that it can be tilted outward. In particular, outward tilting of the material collecting container on both sides of the vehicle is made possible. At the same time, it is expedient if an elevated position of the tilt axle is provided to make it possible to empty the material collecting container onto surfaces at different heights, for example, a vehicle positioned at the side of the suction dredge. The connection for the suction hose is preferably provided on the material collecting container in such a way that there is essentially symmetrical input of the material sucked up, and so that the removal of air from the collecting container also takes place symmetrically.

In other words, a suction dredge, which carries out the method described here for controlling the movement of the articulated hose mount and/or its suction crown, is characterized in that a sensor is assigned to each member of the articulated hose mount, that sensor being suitable for determining directly or indirectly the angle established when two neighboring members move about the joint situated between them under the influence of a respective drive. Control of the drives takes place by means of an electronic control or evaluation system in such a way that it results in set angles that allow the last member or the suction crown to be moved freely in at least an X-Y plane within the context of so-called inverse kinematics. Input for a change in the position of the suction crown by means of a controller preferably takes place in a corresponding coordinate system on an operating unit. It is possible in this way for an operator to bring the suction crown and/or the last member of the articulated hose mount to the desired predetermined position in a direct and targeted manner by means of just one joystick and one control entry.

BRIEF DESCRIPTION OF THE DRAWINGS

Additional details, advantages and refinements of the present invention are derived from the following description of a preferred embodiment with reference to the drawings, in which.

DETAILED DESCRIPTION

Figure 1:
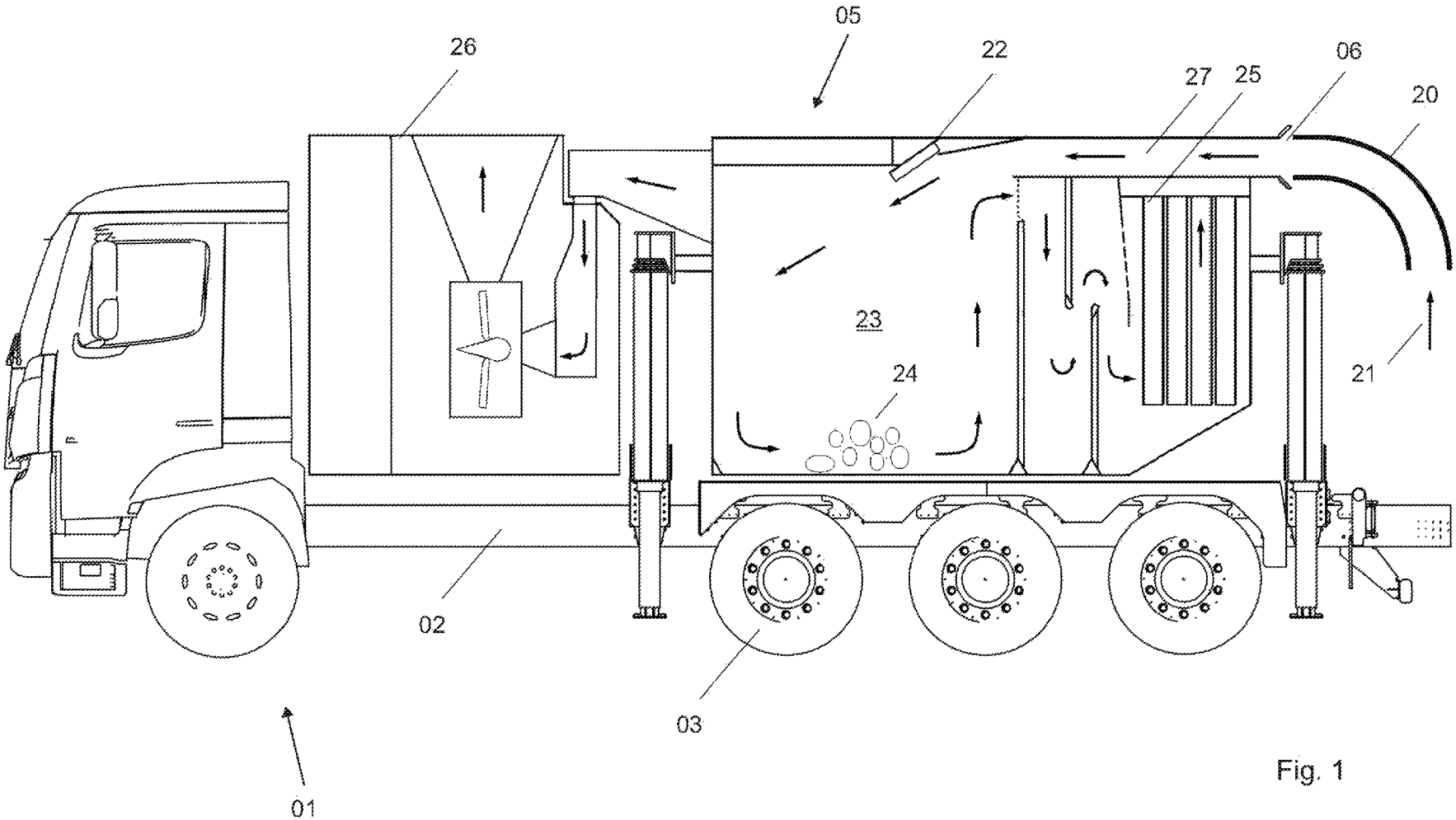
FIG. 1 shows a simplified sectional view of a suction dredge from the side.

FIG. 1 shows a simplified, partially sectional side view of a suction dredge 01, comprising first a vehicle frame 02 and a plurality of vehicle wheels 03 in a traditional manner. In addition, the suction dredge comprises a material collecting container 05 which is mounted on the vehicle frame 02 and/or an auxiliary frame. A suction connection 06 with a suction hose 20 connected to it is provided on the rear end of the material collecting container 05. A suction connection (not shown), by means of which material is sucked in, can be mounted on the free end of the suction hose 20, with the help of a suction stream 21, as symbolized by flow arrows.

In the embodiment illustrated in FIG. 1, the suction stream 21 runs first in the upper region of the material collecting container 05 in an upper air duct 27 up to a baffle 22, where it is deflected into a collecting chamber 23. Based on the increased volume, the velocity of flow is reduced in the collecting chamber 23, so that material 24 is deposited in the collecting chamber. This suction flow then runs into a filter unit 25, where smaller particles, which are still present in the suction stream, are filtered out. In the embodiment shown here, the collecting chamber 23 is in front of the filter unit 25 in the direction of travel. The suction dredge 01 also carries a suction fan 26, which creates the air stream to form the suction stream 21 and is positioned upstream from the material collecting container 05 in the direction of travel.

Figure 2:
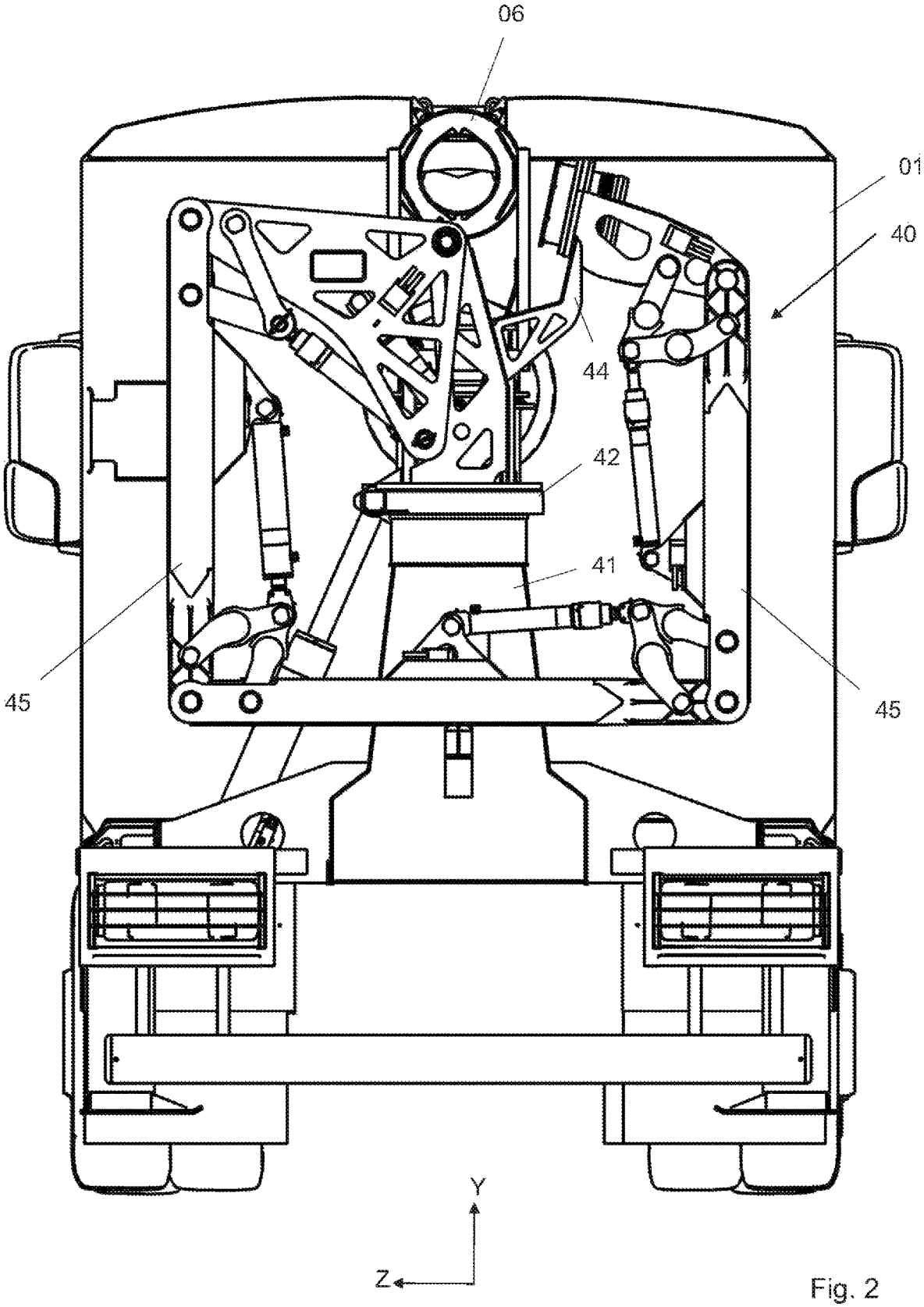
FIG. 2 shows the suction dredge in a view from the rear with an articulated hose mount that is arranged on the rear end of the suction dredge and has been retracted for transport.

FIG. 2 shows a rear view of the suction dredge 01, which carries an articulated hose mount 40 in the retracted condition on its rear end. The suction hose, which is usually attached to the articulated hose mount 40, however, and is moved by it in order to be brought into the desired working position, is not visible in this view. In particular, the articulated hose mount 40 must be brought into this transport position on the suction dredge for the purpose of transport. In the embodiment illustrated here, a plurality of members 45 of the hose mount stands at a 90° angle to one another. The angle between the last two members is greater than 90°, so that the last member can be suspended from a retraining hook 44.

The articulated hose mount is mounted rotatably on a console 41, which is connected to the vehicle frame 02. A pivot drive 42 makes it possible for the entire articulated hose mount 40 to be pivoted approx. 180° about a Y axis when the articulated hose mount has been extended. The pivot drive 42 preferably comprises a rotating ball connection with an integrated worm gear.

Figure 3:
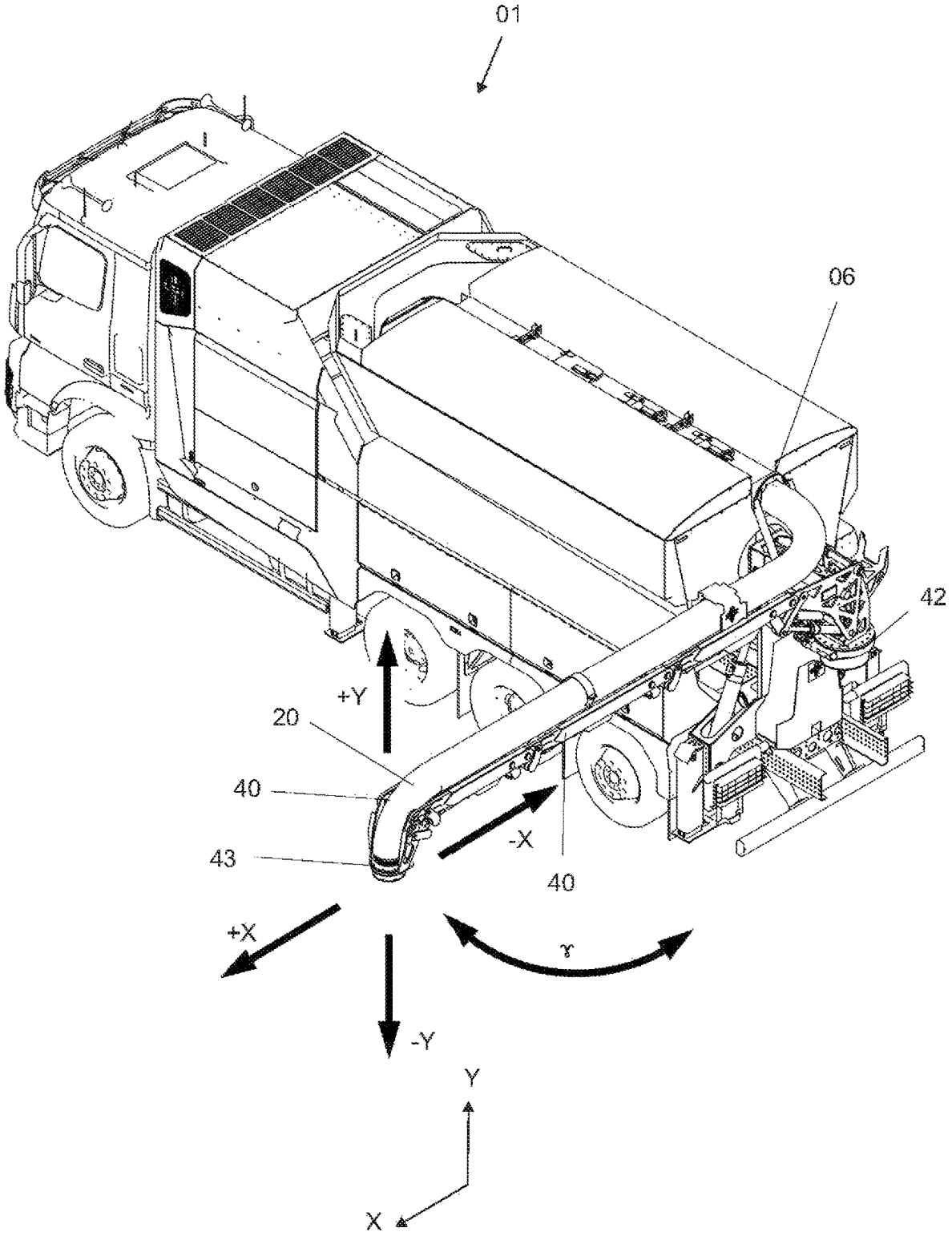
FIG. 3 shows the suction dredge and in a perspective view with the articulated hose mount fully extended.

FIG. 3 shows a perspective view of the suction dredge 01 with the articulated hose mount 40 fully extended. For operation, the articulated hose mount 40 must first be brought out of the transport position (FIG. 2) and into a working position. Since this movement would require a great deal of manual dexterity on the part of the operator, and a mistake in operation could cause relatively major damage, this extension movement is preferably automated. The required angle changes in the individual members and their chronological order into the defined starting position are fixedly predetermined.

At the free end of the suction hose 20, there is a suction crown 43, on which a suction connection (not shown) can be mounted as needed to lengthen it in the negative Y direction. For controlling the movement of the articulated hose mount, as described in detail below, the midpoint in the cross section of the suction crown 43 preferably forms the reference point for the position of the free end of the suction hose and/or the suction connection attached to it in a straight line. FIG. 3 also shows movement arrows illustrating the possible movements at this reference point. Straight-line movements in X and Y directions are possible, and pivoting about a rotational angle γ by activation of the pivot drive 42 is also possible. This describes a cylindrical coordinate system.

Figure 4:
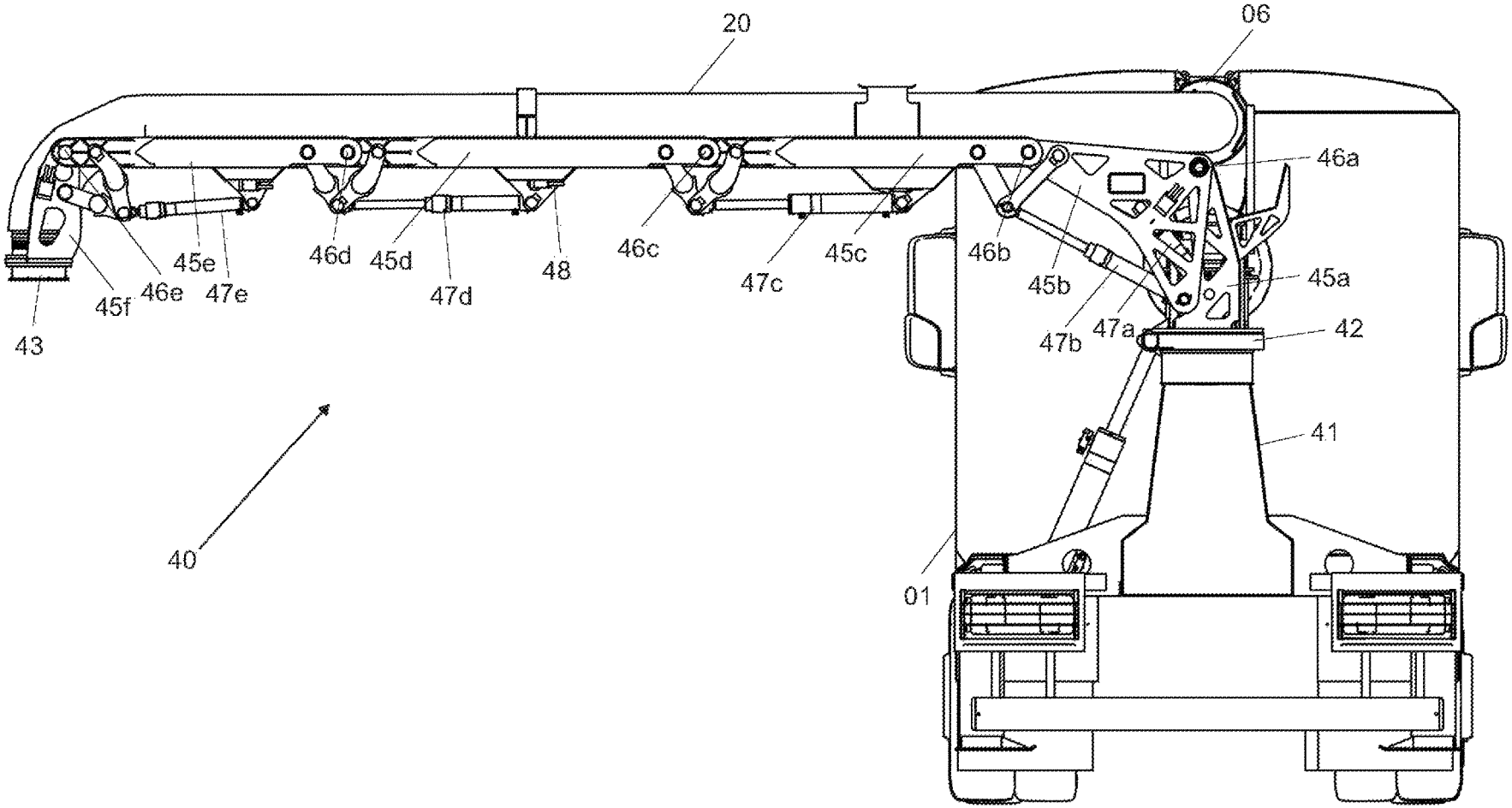
FIG. 4 shows the articulated hose mount extended on the suction dredge in a view from the rear.

FIG. 4 shows a simplified view of suction dredge 01 from the rear with the articulated hose mount 40 completely extended. In the example shown here, the articulated hose mount comprises six mount sections or members 45*a*-45*f*. There is one joint 46*a*-46*e* between each member 45. The angular position of the neighboring members relative to one another can be altered by the respective drives, namely hydraulic cylinders 47*a*-47*e* in the example shown here. In FIG. 4, for example, the members adjacent to the joints 46*c* and 46*d* have assumed an angular position of 180° relative to one another with the hydraulic cylinders 47*c*, 47*d* in the fully extended position. The same members have an angular position of 90° to one another in FIG. 2.

A system for determining the position is arranged on each member 45. In a preferred variant, inclination sensors 48 are used for this purpose. It is also possible to use angle sensors at the articulation points. According to the invention, the articulated hose mount 40 is controlled with the aid of a controller, which carries out the method according to the invention.

Each sensor 48, which may also be placed in another location on the respective member, enables a determination of the inclination as well as preferably also the angular velocity (rotational rate) of the respective member 45. So-called inclination transmitters have proven to be especially suitable for detection of measured values in this regard. These inclination transmitters are used for accurate, rapid detection of prevailing inclinations and/or inclination angles of the members in two axes X, Y that remain stable over the long run. The inclination transmitters as sensors 48 are based on a multi-sensor system, which detects the measured values of six degrees of freedom. Then the measured data thereby detected is digitized and made available over a so-called CANopen protocol to a CAN field bus system for further processing by an electronic evaluation system. Detection of measured inclination values by the respective sensor 48 then takes place by detection of acceleration values in three axes, based on the gravitational field, and the angular velocities for the individual members are detected in three axes by means of a so-called gyroscope.

The last member 45*f*, on which the suction connection is mounted, is always oriented parallel to the Y axis in order to achieve optimum working results. Then the directions of movement in extension and/or retraction in the X direction and movement up and down in the Y direction can be controlled linearly by remote control. A maximum of two joysticks on the remote control are then needed for this. Pivoting can be controlled separately.

The method, which can preferably take place by execution of a data processing program, then determines the output position of the n=6 members cyclically from the position signals of the individual members 45 supplied by the sensors 48. Thus, the position of the reference point 43 (suction crown) on the free end of the last member 45*f* is also known as the current position. Next, a direction vector and a velocity parameter are input, preferably from motion commands, which are input by the operator on an operating unit by using one or two joysticks. Then the required control commands for the individual hydraulic cylinders can be determined from the direction vector and the velocity parameters in order to adjust the required angle changes on the n joints.

Figure 5:
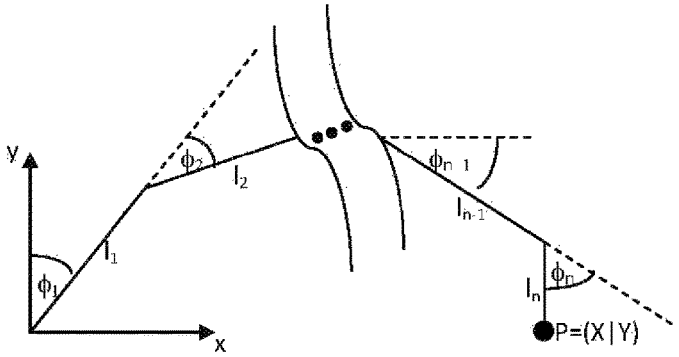
FIG. 5 shows a schematic diagram of the articulated hose mount.
Figure 6:
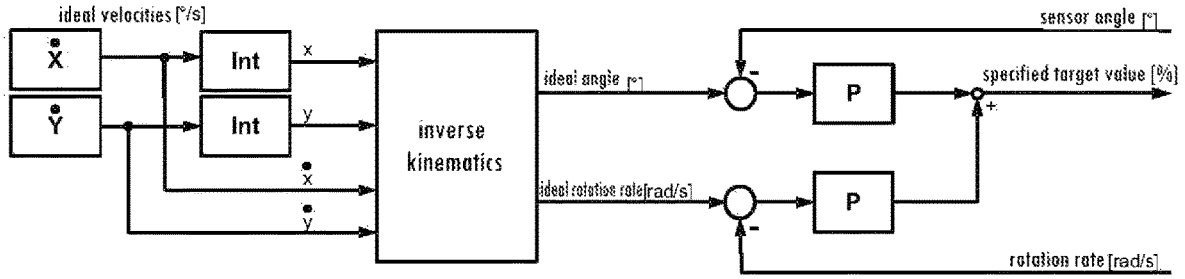
FIG. 6 shows a block schematic of a control system for carrying out the method according to the invention.

Determination of the angle changes is described below as an example. To this end, reference is made to FIGS. 5 and 6. FIG. 5 shows the articulated hose mount in a highly simplified form in the cylindrical coordinate system used here, while FIG. 6 shows essential linkages and system elements of a control system that can be used.

First, the inverse kinematics of the articulated hose mount shall be considered. For the embodiment considered here, the general system requirements are defined as follows:

- the articulated hose mount has n>2 members;
- respective hydraulic cylinders are present as drives between neighboring members in order to change the angular positions of the members relative to one another;
- each member has a position sensor, preferably an inclination sensor;
- each inclination sensor outputs the absolute angle, based on the horizon, and forwards this over a CAN bus to a central control unit, for example;
- each inclination sensor additionally outputs over the CAN bus the angular velocity at which the angle change is carried out;
- the central control unit takes over the generation of target values by means of inverse kinematics as well as the regulation of the individual hydraulic cylinders.

With reference to the coordinates shown in FIG. 5, as can be seen on the articulated hose mount having n>2 members, the position P of the reference point on the suction crown 43 can be calculated as follows:

$$X = l_1 \sin(\phi_1) + l_2 \sin(\phi_1 + \phi_2) + \ldots + l_n \sin(\phi_1 + \ldots + \phi_n) = \sum_{i=1}^{n}\left(l_i \sin\left(\sum_{j=1}^{i}\phi_j\right)\right) \tag{1}$$

$$Y = l_1 \cos(\phi_1) + l_2 \cos(\phi_1 + \phi_2) + \ldots + l_n \cos(\phi_1 + \ldots + \phi_n) = \sum_{i=1}^{n}\left(l_i \cos\left(\sum_{j=1}^{i}\phi_j\right)\right)$$

In this mathematical equation, $I_1$ corresponds to the first member 45*a*, $I_2$ corresponds to the second member 45*b*, etc. The first member $I_1$ can be pivoted at its lower end within the coordinate system X, Y by means of the pivot drive 42.

The goal of the control system in the method according to the invention is to maintain the angles $\phi_1 \ldots \phi_n$ by stipulation of X and Y, so that the articulated hose mount executes a steady movement. There cannot be an analytical solution of equation (1) here because only two equations are available for determining n unknowns. To solve this problem, each joint 46 is regarded as a spring with the stiffness $s_1, \ldots, s_n$ and is held in the positions $\phi_{1,0}, \ldots, \phi_{n,0}$. The movement of P is implemented by the forces $F_x$ and $F_y$ acting on P. Disregarding friction and the weight of the elements, this yields the movement equations:

$$\begin{aligned} J_1\ddot{\phi}_1 &= (\phi_{1,0} - \phi_1)s_1 + (F_x\cos(\phi_1) - F_y\sin(\phi_1))l_1 \\ J_2\ddot{\phi}_2 &= (\phi_{2,0} - \phi_2)s_2 + (F_x\cos(\phi_1 + \phi_2) - F_y\sin(\phi_1 + \phi_2))l_2 \\ &\vdots \\ J_n\ddot{\phi}_n &= (\phi_{n,0} - \phi_n)s_n + \left(F_x\cos\left(\sum_{j=1}^{n}\phi_j\right) - F_y\sin\left(\sum_{j=1}^{n}\phi_j\right)\right)l_n \end{aligned} \tag{2}$$

In a steady state, these equations hold:

$$\begin{aligned} 0 &= (\phi_{1,0} - \phi_1)s_1 + (F_x\cos(\phi_1) - F_y\sin(\phi_1))l_1 \\ 0 &= (\phi_{2,0} - \phi_2)s_2 + (F_x\cos(\phi_1 + \phi_2) - F_y\sin(\phi_1 + \phi_2))l_2 \\ &\vdots \\ 0 &= (\phi_{n,0} - \phi_n)s_n + \left(F_x\cos\left(\sum_{j=1}^{n}\phi_j\right) - F_y\sin\left(\sum_{j=1}^{n}\phi_j\right)\right)l_n \end{aligned} \tag{3}$$

Together with the equations in (1) above, this yields an equation system with n+2 equations and n+2 unknowns $\phi_1 \ldots \phi_n$, $F_x$ and $F_y$. To reduce the system to the order n, the last two equations (3) must be solved for $F_x$ and $F_y$. To this end, they are converted to the form:

$$\begin{aligned} 0 &= a_1 + F_x a_2 - F_y a_3 \\ 0 &= b_1 + F_x b_2 - F_y b_3 \end{aligned} \tag{4}$$

where $$\begin{aligned} a_1 &= (\phi_{n-1,0} - \phi_{n-1})s_{n-1},\ a_2 = \cos\left(\sum_{j=1}^{n-1}\phi_j\right)l_{n-1},\ a_3 = \sin\left(\sum_{j=1}^{n-1}\phi_j\right)l_{n-1} \\ b_1 &= (\phi_{n,0} - \phi_n)s_n,\ b_2 = \cos\left(\sum_{j=1}^{n}\phi_j\right)l_n,\ b_3 = \sin\left(\sum_{j=1}^{n}\phi_j\right)l_n \end{aligned} \tag{5}$$

The forces are then obtained as:

$$\begin{aligned} F_x &= \frac{b_1 a_3 - b_3 a_1}{a_2 b_3 - b_2 a_3} \\ F_y &= \frac{b_1 a_2 - b_2 a_1}{a_2 b_3 - b_2 a_3} \end{aligned} \tag{6}$$

The divisions may be carried out at any time because resubstitution and applying the addition theorems yields the following for the denominator:

$$\begin{aligned} a_2 b_3 - b_2 a_3 &= \\ &\cos\left(\sum_{j=1}^{n-1}\phi_j\right)l_{n-1}\sin\left(\sum_{j=1}^{n}\phi_j\right)l_n - \cos\left(\sum_{j=1}^{n}\phi_j\right)l_n\sin\left(\sum_{j=1}^{n-1}\phi_j\right)l_{n-1} = \\ &l_{n-1}l_n\left(\cos\left(\sum_{j=1}^{n-1}\phi_j\right)\sin\left(\sum_{j=1}^{n}\phi_j\right) - \cos\left(\sum_{j=1}^{n}\phi_j\right)\sin\left(\sum_{j=1}^{n-1}\phi_j\right)\right) = \\ &l_{n-1}l_n\sin(\phi_n) \end{aligned} \tag{7}$$

Since $\phi_n \neq 0$ holds due to the angular limitation of the articulated hose mount, the denominator is different from zero.

The equation system is now as follows:

$$0 = f(x) = \begin{bmatrix} \sum_{i=1}^{n}\left(l_i\sin\left(\sum_{j=1}^{i}\phi_j\right)\right) - X \\ \sum_{i=1}^{n}\left(l_i\cos\left(\sum_{j=1}^{i}\phi_j\right)\right) - Y \\ (\phi_{1,0} - \phi_1)s_1 + (F_x\cos(\phi_1) - F_y\sin(\phi_1))l_1 \\ \vdots \\ (\phi_{n-2,0} - \phi_{n-2})s_{n-2} + \left(F_x\cos\left(\sum_{j=1}^{n-2}\phi_j\right) - F_y\sin\left(\sum_{j=1}^{n-2}\phi_j\right)\right)l_{n-2} \end{bmatrix} \tag{8}$$

where $F_x$ and $F_y$ are obtained from (6) and $x=[\phi_1 \ldots \phi_n]^T$.

This equation system cannot be solved analytically, which is why a Newtonian method (or some other adequate method) should be used to solve it. To this end, the function $f(x+\Delta)$ in the equation is replaced by a Taylor series expansion of the first order:

$$0 = f(x_{k+1}) = f(x_k) + \frac{\partial f}{\partial x}\bigg|_{x_k} \underbrace{(x_{k+1} - x_k)}_{=\Delta} \tag{9}$$

yielding the iteration:

$$\Delta = -\underbrace{\left(\frac{\partial f}{\partial x}\bigg|_{x_k}\right)}_{=J}^{-1} f(x_k) \tag{10}$$

$$x_{k+1} = x_k + \Delta$$

with the Jacobi matrix J of f. Instead of calculating the inverse of the Jacob matrix, the equation system:

$$J\Delta = -f \tag{11}$$

is solved for Δ with the help of a Gaussian elimination (or some other adequate method).

To precontrol the angular velocity in the individual elements, it is possible to calculate as follows by deriving equation (8) according to time:

$$0 = \frac{\partial f}{\partial x}\frac{dx}{dt} = J\dot{x} - \begin{bmatrix} \dot{X} \\ \dot{Y} \\ 0 \\ \vdots \\ 0 \end{bmatrix} \tag{12}$$

And then by solving the linear equation system for $\dot{x}$:

$$\begin{bmatrix} \dot{X} \\ \dot{Y} \\ 0 \\ \vdots \\ 0 \end{bmatrix} = J\dot{x} \tag{13}$$

the angle changes $\dot{x}=[\dot{\phi}_1 \ldots \dot{\phi}_n]^{T^T}$ can be calculated from the change in the positions $\dot{X}$ and $\dot{Y}$ over time.

It should be pointed out that the mathematical methods presented above show only one option for carrying out the steps of the method according to the invention. Those skilled in the art will recognize that modified methods can also be used.

To carry out the method described here, a regulator like that shown in principle in FIG. 6 may be used. The input variables for the controlled system are as follows:

- The ideal angular velocity for each segment (from the inverse kinematics described above)
- Ideal angle for each segment (from the inverse kinematics described above)
- The actual angular velocity of each member (measured variable from the sensor)
- Actual angle of each segment (measured variable from the sensor).

Those skilled in the art will recognize that the regulator can be adapted, for example, if certain limit values are also to be taken into account, as already described above.

Each member 45 preferably has its own regulator which sets the hydraulic cylinder 45 (drive) on the basis of actual variable and target variables, so that the ideal angle and the ideal angular velocity are set on the member.

The articulated hose mount 40 is preferably always aligned in the optimal static kinematic position. Since the movement of the reference point 43 should be as linear as possible, a complex superpositioning of the movements of the individual members of the articulated hose mount is necessary. A downstream position regulation can preferably permanently smooth the movements initiated by the controller. In addition, blocked regions, in which the range of movement may be restricted, can also be defined. This relates, for example, to the area in which the vehicle is located in order to prevent collisions of the articulated hose mount with other vehicle parts.

LIST OF REFERENCE NUMERALS

01 Suction dredge
02 Vehicle frame
03 Vehicle wheels
05 Material collecting container
06 Suction connection
20 Suction hose
21 Suction stream
22 Baffle
23 Collecting chamber
24 Deposited material
25 Filter unit
26 Suction fan
27 Upper air duct
40 Articulated hose mount
41 Console
42 Pivot drive
43 Suction crown/reference point
44 Retaining hook
45 Members of the articulated hose mount
46 Joints
47 Drives/hydraulic cylinders
48 Sensors

The invention claimed is:

1. A method for controlling the movement of an articulated hose mount, which carries the suction hose of a suction dredge, wherein the articulated hose mount has at least n>2 members and a change in angle can be induced between neighboring members with the help of a respective drive, wherein the following steps are carried out:

a) determining the starting position of the n members with the help of sensors;
b) input of a direction vector and a velocity parameter;
c) determining a target position, which should be assumed by a suction crown on the free end of the last member;
d) determining n angle changes which must be carried out on the n members in order to reach the target position while maintaining the following conditions:
   d.i. the suction crown moves into the target position along a straight path of movement;
   d.ii. the sum of all angle changes on then members is minimal;
e) controlling the drives associated with the n members in order to perform the predetermined angle change on the n members;
f) cyclically repeating the aforementioned method steps until the direction vector and/or the velocity parameter are zero.

2. The method according to claim 1, wherein n angular velocities are additionally determined in step d) with which the angle changes are carried out in step e).

3. The method according to claim 1, wherein the direction vector to be input and preferably also the velocity parameters are determined by an operator from the deflection of at least one operating level carried out.

4. The method according to claim 1, wherein limit values, which are maintained in determining the angle change and/or the angular velocity can be preselected for at least one of the n members.

5. The method according to claim 1, wherein the angle changes are determined by using the movement equations of an inverse kinematics of the articulated hose mount taking into account the angular position of each one of the n members recorded by the sensors.

6. The method according to claim 1, wherein the angle changes are determined by access to a table of values in which all the ideal positions of all the n members are stored for all possible target positions, wherein the target position closest to the current position is approached along the direction vector.

7. The method according to claim 1, wherein the direction vector is made up of two one-dimensional subvectors, and the target position lies in a vertically spanned X-Y plane.

8. The method according to claim 7, wherein a rotational angle is input which defines the desired angular position of the vertically spanned X-Y plane about a rotational axis of the articulated hose mount, and in that the articulated hose mount is moved into this angular position by a pivot drive.

9. A suction dredge comprising:

a vehicle frame;

a material collecting container;

a suction fan;

an articulated hose mount which has a suction hose with a receiving opening on a suction crown and has at least n>2 members between which a change in angle can be induced with the help of a respective drive;

a control unit for controlling the movement of the articulated hose mount;

characterized in that the control unit is configured to carry out a method according to claim 1.

* * * * *